US005547041A

United States Patent [19]

Morral Gispert

[11] Patent Number: 5,547,041

[45] Date of Patent: Aug. 20, 1996

[54] LADDER

[75] Inventor: Jaime Morral Gispert, Polinya, Spain

[73] Assignee: Astral, Sociedad Anónima de Construcciones Metálicas, Polinya, Spain

[21] Appl. No.: 297,046

[22] Filed: Aug. 29, 1994

[30] Foreign Application Priority Data

Sep. 21, 1993 [ES] Spain ..... 9302043

[51] Int. Cl.[6] ..... E06C 7/08

[52] U.S. Cl. ..... 182/228; 182/46

[58] Field of Search ..... 182/228, 46

[56] References Cited

U.S. PATENT DOCUMENTS 1,349,125 8/1920 Full ..... 182/228 X
2,992,697 7/1961 Klages ..... 182/228 X
3,944,024 3/1976 Adas ..... 182/228 X

FOREIGN PATENT DOCUMENTS 2235236 2/1991 United Kingdom ..... 182/228

*Primary Examiner*—Alvin C. Chin-Shue
*Attorney, Agent, or Firm*—Jacobson, Price, Holman & Stern, PLLC

[57] ABSTRACT

A ladder of the kind which comprises two elongated and vertically extending, rigid uprights, having axially extending recesses. A rung is provided having apertures defined by sleeves having uninterrupted inner surfaces, for receiving therethrough the uprights. An elongated split sleeve is provided having a protrusion on an inner edge for engaging with the axially extending recess of the upright. The split sleeve slides around and is coaxially aligned with the rigid upright. The arrangement of the ladder is simple to assemble, having few parts, which fit together without requiring additional bolting or securing.

5 Claims, 1 Drawing Sheet

LADDER

This invention refers to a ladder and, more particularly, to the means for attachment of the rungs to the uprights.

Although this ladder can be constituted in any manner and applied to differing functions, it has been designed mainly to be used in swimming pools.

The object of this invention is to obtain a ladder at a reasonable price and at the same time which is easy to assemble, enabling it to be assembled by anybody, making this ladder suitable, for example, for marketing as "do-it-yourself" merchandise, the consumer being able to buy the component parts loose and to assemble it himself.

In this new ladder, the conventional assembly of the rungs to the upright using screws and nuts has been dispensed with, and at the same time the holes to be made in the uprights are eliminated, so they are not weakened.

A characteristic trait of this ladder is that recesses are made in the edges of the uprights, into which two split sleeves are attached, which have on their inside edge protrusions which match these recesses, on top of the spilt sleeve of which the rung is attached by its ends, this rung having a tubular aperture defined by a sleeve in each for this purpose.

Between the sleeves and the tubular finish, support components have been provided to hold up the rungs.

Likewise, between the spilt sleeve and the tubular sleeves of the rung, anchorage components are fitted, which ensure mutual attachment.

The split sleeve is open on one of its generating lines to assist its attachment to the upright.

These and other characteristics can be appreciated better from the detailed description which follows, to assist which a sheet of sketches is attached, representing a practical case of application, which is cited solely for the purpose of an example and is not limitative of the scope of the invention.

In the sketches:

Figure 1:
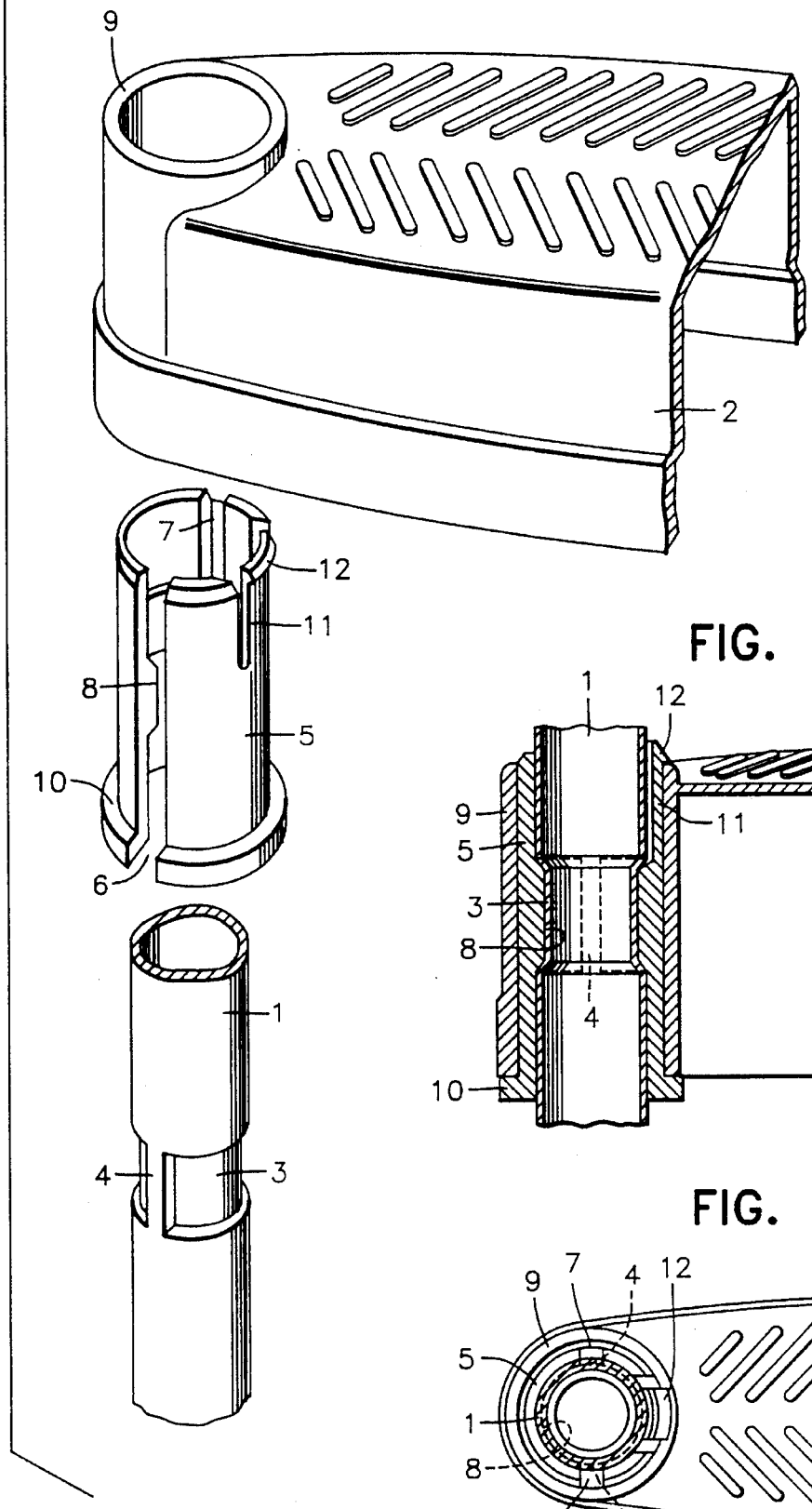
FIG. 1 represents a piece by piece perspective of the means for attachment of the rungs to the uprights.

As per the sketches, the metal, tubular uprights 1 present a recess 3 on their edges, at the spot where the rungs 2 are to be attached, which in this case is achieved by press drawing, the result being two opposite arched recesses, separated by two opposite ridges 4.

Two plastic split sleeve 5 are attached on the uprights in each recess 3 by threading; these sleeves are open on one of their generating lines 6 and the opposite generating line has a reduction in thickness 7, determining an elastic hinge which allows the sleeve 5 to open to attach it crossways to the upright 1. In the threading operation of the split sleeve on the upright in the recess 3 of the upright, a protrusion 8 is fitted which matches the inside of the sleeve 5 in order to achieve a grip which prevents coaxial displacement of the split sleeve on the upright.

The rung 2 is supported and held on the sleeve 5 by its ends, for which it has two tubular sleeves 9 on these ends, which rest on a lower flange 10 of the outer edge of the split sleeve. This attachment in turn keeps the sleeve 5 applied against the upright 1.

Figure 2:
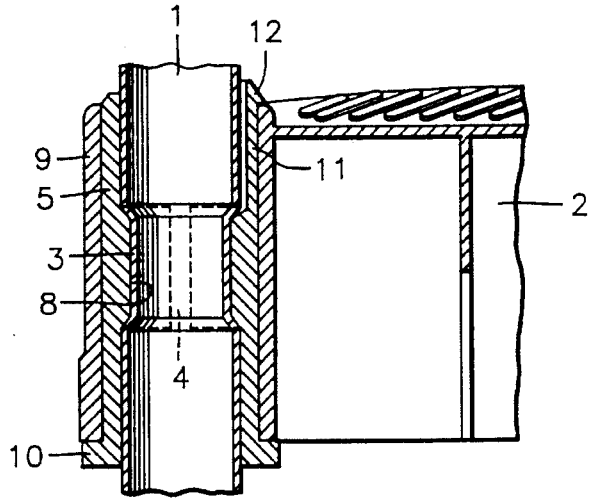
FIG. 2 illustrates an elevational cross-section of the attachment of the rung to the upright.
Figure 3:
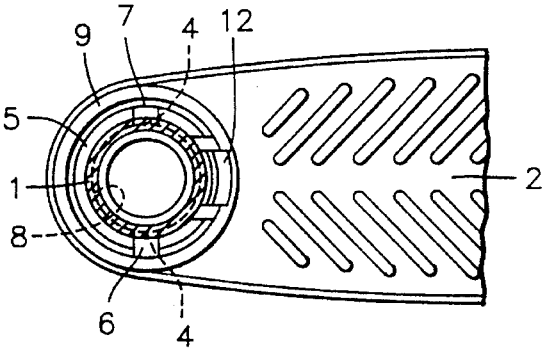
FIG. 3 is a plan view of said attachment.

To prevent accidental upwards displacement of the rung 2 once it is attached, an elastic finger 11, finished with an outer conical rib 12, has been fitted on the edge of the sleeve 5, the rib of which catches on the edge of the tubular sleeve 9 of the rung (FIG. 2).

It is understood that the recess 3 of the upright can take up part or all of its edge, depending on the means used to obtain it.

As well as the support of the rung on the sleeve 5, this could be the other way round, in this case the tubular sleeve 9 of the rung having an inner edge flange on its upper mouth which will rest on the upper edge of the sleeve 5, in which case the split sleeve would not have the elastic finger 11, which in this case the tubular sleeve 9 would have on its inner mouth.

What is claimed is:

1. A ladder comprising two elongated and vertically extending, rigid uprights, each having at least one axially extending recess portion;

at least one rung extending horizontally between said two uprights and having apertures defined by sleeves having uninterrupted inner surfaces for receiving therethrough said rigid uprights; and a means for securing said rungs to said uprights comprising an elongated split sleeve in coaxial alignment around one of said uprights, said split sleeve having a protrusion on an inner edge for engaging with said axially extending recess portion and wherein said sleeve of said rung slides over said split sleeve aligned on around said upright, to secure said rung in position along the length of said rigid upright.

2. The ladder according to claim 1, wherein said split sleeve is provided with an outwardly extending flange, at one end, said flange extending around the periphery of said split sleeve.

3. The ladder according to claim 6 wherein said split sleeve is provided with an axially extending elastic finger, said finger provided with an outwardly extending rib which overlies an edge of said aperture to provide engagement between said split sleeve and said sleeve of said rung.

4. The ladder according to claim 1 wherein said upright is a metal tube.

5. The ladder according to claim 1 wherein said sleeve has a reduced thickness region providing said sleeve with flexibility.

* * * * *